US011347187B2

(12) United States Patent
Rotaru et al.

(10) Patent No.: US 11,347,187 B2
(45) Date of Patent: May 31, 2022

(54) METHOD OF ASSEMBLING A TIMEPIECE

(71) Applicant: ROLEX SA, Geneva (CH)

(72) Inventors: Mihaela Rotaru, Geneva (CH); Pierre Villaret, Villy-le-Pelloux (FR)

(73) Assignee: ROLEX SA, Geneva (CH)

( * ) Notice: Subject to any disclaimer, the term of this patent is extended or adjusted under 35 U.S.C. 154(b) by 118 days.

(21) Appl. No.: 16/383,797

(22) Filed: Apr. 15, 2019

(65) Prior Publication Data

US 2019/0324402 A1 Oct. 24, 2019

(30) Foreign Application Priority Data

Apr. 23, 2018 (EP) ..... 18168748

(51) Int. Cl.
*G04B 37/10* (2006.01)
*G04D 7/00* (2006.01)
*G04B 37/12* (2006.01)

(52) U.S. Cl.
CPC ..... *G04B 37/106* (2013.01); *G04D 7/007* (2013.01); *G04B 37/12* (2013.01)

(58) Field of Classification Search
CPC ..... G04B 37/106; Y10T 29/49579; Y10T 29/49584
See application file for complete search history.

(56) References Cited

U.S. PATENT DOCUMENTS 9,977,404 B2 5/2018 Dupertuis
10,228,661 B2 3/2019 Dépraz
2011/0235476 A1 9/2011 Hiranuma
2017/0023916 A1 1/2017 Dupertuis
2017/0060097 A1 3/2017 Dépraz

FOREIGN PATENT DOCUMENTS

CH 608 325 A 1/1979
CH 702 865 A2 9/2011
CH 702865 A2 * 9/2011 ..... G04B 37/08
(Continued)

OTHER PUBLICATIONS

English translation CH702968 (Year: 2011).*
(Continued)

*Primary Examiner* — Jason L Vaughan
*Assistant Examiner* — Amanda Kreiling
(74) *Attorney, Agent, or Firm* — Westerman, Hattori, Daniels & Adrian, LLP

(57) ABSTRACT

Method of assembling a timepiece comprising a watch movement and a water-resistant case, the method comprising a first stage of closing the case by fitting and securing a first case element, more particularly a back, and then a second stage of closing the case by actuation of a second case element, more particularly a stem, in particular a winding stem or a valve stem or a push-button stem, the second case element being mobile between a first configuration, in which a fluid communication between the interior of the case and an environment outside the case is permitted, and a second configuration, in which the fluid communication between the interior of the case and the environment outside the case is limited, the second stage of closing being an actuation of the passage of the second element from the first configuration to the second configuration.

22 Claims, 3 Drawing Sheets

(56) References Cited

FOREIGN PATENT DOCUMENTS

| | | | |
|---|---|---|---|
| CH | 706 717 | A2 | 1/2014 |
| EP | 3121663 | A1 | 1/2017 |
| EP | 3136189 | A1 | 3/2017 |

OTHER PUBLICATIONS

C. Attinger, "Influence of the fluid driven for the period of oscillation of a spring pendulum", Annual bulletin of the SSC, 1947, pp. 406-445; with English machine translation (cited in the Specification; total 86 pages).

C. Attinger, "Barometric pressure and watches. Various applications", Annual bulletin of the SSC, 1948, pp. 505-506; with English machine translation (cited in the Specification; total 7 pages).

European Search Repod and Written Opinion dated Oct. 29, 2018 issued in counterpart application No. EP18168748; w/ English machine translation (12 pages).

* cited by examiner

METHOD OF ASSEMBLING A TIMEPIECE

This application claims priority of European patent application No. EP18168748.4 filed Apr. 23, 2018, the content of which is hereby incorporated by reference herein in its entirety.

The invention relates to a method of mounting or assembling a water-resistant timepiece. The invention also relates to a timepiece, more particularly a timepiece obtained by the implementation of a suchlike method.

A variation in the pressure on a watch movement modifies its rate. The variation is in the order of 0.01 to 0.02 seconds per day and per mm Hg, or 10 to 15 seconds per day and per bar. This effect of pressure on the rate of the watch is utilized more particularly in order to verify the sealing integrity of the case as described in document EP3136189.

The stage of casing-up a movement in a water-resistant watch case similarly influences the rate of the movement, since locking the back of the case brings about an increase in the pressure within the case. This pressure balances out over time until it becomes equal to the pressure of the environment outside the watch case. However, the adjustment of the bare movement, as it will have been submitted for testing or certification, for example to the COSC, is disturbed for a period of a few months, this being the time required for the over pressurization to disappear. The watch, once it has been assembled, will thus exhibit a rate which differs from that of the bare movement.

The stage of casing-up involves placing the movement in its case, securing it there, inserting the crown stem and then closing the back. The variation in pressure to which the movement is subjected during casing-up corresponds to the change between:

- a first free volume inside the case with the back in place and with the sealing gasket not compressed, but in contact with the surfaces on which it will bear, and
- a second free volume inside the case with the back locked and the sealing gasket crushed.

The variation in pressure thus depends on the geometry of the case and the movement. For a watch having a diameter of about 40 mm, the variation in pressure associated with closing the back may bring about a delay in the rate close to one second per day.

According to the document "Influence of the fluid driven for the period of oscillation of a spring pendulum", C. Attinger, Annual bulletin of the SSC, 1947, the period of oscillation of a balance wheel is influenced by the ambient gas. The rate-pressure function is generally in the order of 0.01 to 0.02 s/j per mm Hg, with a delay when the pressure increases. The larger the balance wheel, the smaller the variations in rate.

According to the document "Influence of barometric variations on the rate of marine chronometers", E. Guyot, Annual bulletin of the SSC, 1938, the effect of the atmospheric pressure on the rate of a particular watch is characterized by its barometric coefficient C (variation in its rate per unit of pressure). It is assumed to be constant in relation to the common operating temperatures of a watch, and it must be measured for each timepiece (or each construction).

This effect is utilized more particularly for testing of the sealing integrity of watch cases, as described in patent application EP3121663 or by C. Attinger as early as in 1948 in the document "Barometric pressure and watches. Various applications", C. Attinger, Annual bulletin of the SSC, 1948.

The measurements conducted on different calibers in order to assess the variation in rate depending on the pressure show a variation of more than 10 seconds per day for 1 bar of difference and similarly confirm that the cased-up movement is essentially no longer subject to atmospheric variations. A period of stabilization has been estimated at three months in order for the pressures inside and outside a watch case to balance one another out and for the rate to become stabilized.

Although one advantage associated with the availability of water-resistant watches has been to permit their portability in the most diverse environments, a consequence has been the introduction of a new problem: the variation in the rate between the movement at the time when it was adjusted, or tested by the COSC, and the movement installed in the watch, with the back closed.

In fact, closing the back of a water-resistant case brings about an increase in pressure within the case, which may reach almost 0.1 bar, or a difference in rate of one second per day due to the locking of the back.

Theoretical pressure calculations are set out below for a watch case exhibiting a back screwed onto the case middle.

The pressure inside a water-resistant watch case conforms to Boyle's law:

$$p1 \times V1 = p2 \times V2$$

where p1: the pressure surrounding the watch case at the moment when the environment inside the watch case is insulated from the environment outside the watch case;

V1: the free volume in the interior or the volume of environmental gas inside the case at the moment when the environment inside the watch case is insulated from the environment outside the watch case;

p2: the pressure inside the watch case or the pressure of the environment inside the watch case once the first element is completely mounted and has been tightened onto the case middle;

V2: the free volume in the interior or the volume of environmental gas inside the case once the first element is completely mounted and has been tightened onto the case middle.

If the atmospheric pressure p1 (for example 0.966 bar) is associated with the volume V1 of the case comprising the movement, with the back fitted, the variation in pressure Δp is given by the equation:

$$\Delta p = p1 \times \Delta V / V2 \text{ where } \Delta V = \pi \times h \times d^2/4$$

where:

d: the external diameter of the thread of the back;

h: the difference in height of the first sealing gasket between the configuration in which the environment inside the watch case is insulated from the environment outside the watch case and the configuration once the first element is completely mounted and has been tightened onto the case middle.

By way of example, closing the back of a watch having a diameter of 40 mm, including a back having a thread diameter of 32 mm, of which the sealing integrity is assured by an O-ring seal having a torus diameter of 0.8 mm, will cause a difference in pressure of 0.028 bar at the time of locking the back. This difference will bring about a variation in rate of about 0.3 second per day.

In the case of water-resistant watches, it is considered that equilibrium may be achieved by the diffusion of air through the gaskets, and that the adjustment of the rate at sea level will be compensated rapidly if its owner is at a high altitude. It could prove to be beneficial, however, both at the level of the adjustment during manufacture and during subsequent operations, to ensure that the adjustment performed by the watchmaker is maintained. This is the case more particularly at the level of after-sales service, where the client is at risk of observing a major difference in the rate, during the first months following an intervention on the watch, as a result of the variation in pressure inside the watch case.

It would be possible to overcome the problem by anticipating this variation in pressure and by adjusting the rate of the movement accordingly, so as to ensure an adequate rate once the movement has been cased-up, immediately after casing-up, although this involves a complicated calculation and is achievable only with difficulty in after-sales service. In addition, the rate would then be inappropriate a few months after the intervention, once the pressures are in balance.

The aim of the invention is to propose a method of mounting or assembling a water-resistant timepiece so as to be able to address the above-mentioned disadvantages and to improve the methods that are familiar from the prior art. In particular, the invention proposes a method of mounting that is simple and allows the chronometric precision of the timepieces that have been mounted in this way to be improved.

A method of assembling according to the invention is defined by point 1 below.

1. Method of assembling a timepiece comprising a watch movement and a water-resistant case, the method comprising the following stages:
   - a first stage of closing the case by fitting and securing a first case element, more particularly a back, and then
   - a second stage of closing the case by actuation of a second case element, more particularly a stem, in particular a winding stem or a stem of a valve or a stem of a push-button, the second case element being mobile between a first configuration, in which a fluid communication between the interior of the case and an environment outside the case is permitted, and a second configuration, in which the fluid communication between the interior of the case and the environment outside the case is limited,
   - the second stage of closing being an actuation of the passage of the second element from the first configuration to the second configuration.

Different embodiments of the method of assembling are defined by points 2 to 12 below.

2. The method of assembling as defined in the preceding point, wherein the second element is arranged so that the passage from the first configuration to the second configuration of the second element causes a displacement of fluid inside the case of less than or equal to 25%, or even less than or equal to 10%, or even less than or equal to 5%, of the displacement of fluid caused by:
   - passage of the first element from a third configuration, in which a fluid communication between the interior of the case and the environment outside the case is permitted, to a fourth configuration, in which the fluid communication between the interior of the case and the environment outside the case is limited; or
   - positioning and securing the first element on the case.
3. The method of assembling as defined in one of the preceding points, wherein it comprises a third stage of testing the sealing integrity of the case subsequently to the second stage, more particularly a third stage of testing the sealing integrity of the case in which a value for the rate of the movement is measured.
4. The method of assembling as defined in one of the preceding points, wherein it comprises, prior to the first stage, a stage of adjusting the rate of the movement.
5. The method of assembling as defined in one of the preceding points, wherein the first stage of closing the case comprises screwing a back onto a case middle.
6. The method of assembling as defined in the preceding point, wherein screwing the back onto the case middle deforms, in particular compresses, a first sealing gasket.
7. The method of assembling as defined in one of the preceding points, wherein the second stage of closing the case comprises a displacement of the second element from the first configuration to the second configuration, more particularly a longitudinal displacement of a stem, in particular a winding stem or a valve stem or a push-button stem.
8. The method of assembling as defined in one of the preceding points, wherein the second element, in the second configuration, is in a situation of contact with a second sealing gasket and, in the first configuration, in a situation of interrupted contact or partially interrupted contact with the second sealing gasket.
9. The method of assembling as defined in one of the preceding points, wherein the second element is a stem and wherein, in the first configuration, the stem exhibits a portion of reduced cross section facing the second sealing gasket.
10. The method of assembling as defined in one of the preceding points, wherein it comprises a third stage of actuation of the second case element so as to position the second case element in the first configuration, the third stage being prior to the first stage.
11. The method of assembling as defined in one of the preceding points, wherein the second element is a stem and wherein a displacement in order to place the second element in the first configuration requires an action on a third element of the watch movement, more particularly action on a pull-out piece.
12. The method of assembling as defined in one of the preceding points, wherein the second element is a stem and wherein a displacement in order to place the second element in the second configuration is performed independently of an action on a third element of the watch movement, more particularly independently of an action on a pull-out piece.

Timepieces according to the invention are defined by points 13 to 15 below.

13. The timepiece, more particularly a wristwatch, comprising a movement and a watch case comprising a second case element, more particularly a stem, in particular a winding stem or a stem of a valve or a stem of a push-button, the second element being arranged so as to be mobile between a second configuration adapted to ensure the sealing integrity of the case and a first configuration adapted to permit fluid communication between the interior of the watch case and an environment outside the watch case.
14. The timepiece as defined in the preceding point, wherein the stem is a stem exhibiting a portion of reduced cross section intended to come into a position facing the second sealing gasket in the first configuration of the stem, and/or wherein the second element is arranged to be movable unidirectionally from the first configuration to the second configuration, and/or wherein the second element is arranged to be movable from the second configuration to the first configuration by the action of a watchmaker on the movement, and/or wherein the second element is arranged to be freely movable from the first configuration to the second configuration.

15. The timepiece, more particularly a wristwatch, obtained by the implementation of the method as defined in one of points 1 to 12.

The accompanying figures depict, by way of example, an embodiment of a timepiece according to the invention.

Figure 1:
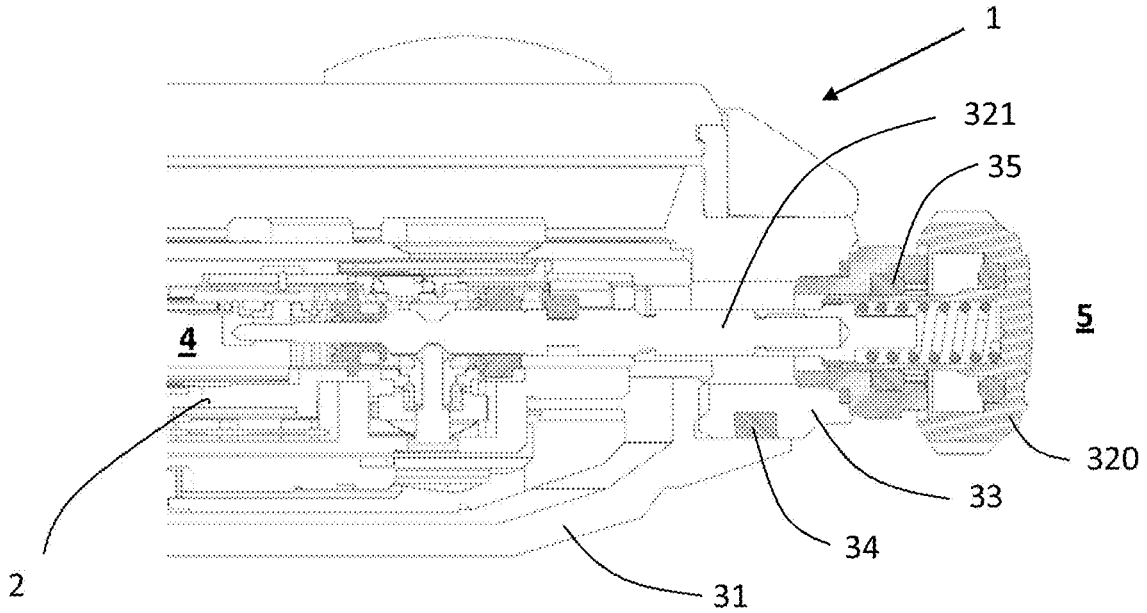
FIGS. 1 to 4 are views in cross section of an embodiment of the timepiece in different configurations.

A first embodiment of a timepiece 1 is described below with reference to FIGS. 1 to 4. The timepiece is a watch, for example, in particular a wristwatch. The timepiece comprises a movement 2. The movement is a mechanical movement. The movement may in particular be an automatic mechanical movement.

The timepiece also comprises a watch case, more particularly a water-resistant watch case. The watch case is intended to enclose the movement in a water-resistant manner. Thus, the watch case defines an environment 4 inside the watch case that is insulated from an environment 5 outside the watch case.

The watch case comprises a case middle 33 closed on a first side by a glass and on a second side by a first case element, for example by a back 31. It also comprises the one or more elements necessary for the attachment of the second case element, for example a crown tube.

The sealing integrity between the case middle and the first element is assured by a first sealing gasket 34.

The first element may be mounted screwed onto the case middle, that is to say that the first element may be connected by a helical link to the case middle. As an alternative, the first element may be mounted with the help of screws on the case middle. Preferably, the mounting of the first element compresses or crushes the first sealing gasket. This compression or this crushing of the first sealing gasket causes a reduction in the volume inside the watch case. On the assumption that the environment 4 inside the watch case is insulated, from the time of continuous contact around the entire circumference of the first gasket with the first element, deformation, more particularly compression or crushing of the first sealing gasket, causes an increase in pressure in the environment inside the watch case, assuming that the watch case is not open at another point.

The case is further closed by a second case element. For example, in the embodiment represented in FIGS. 1 to 4, the second element is a winding crown 320 associated with a stem 321 passing through the case middle, in particular a crown stem passing through the case middle.

Figure 2:
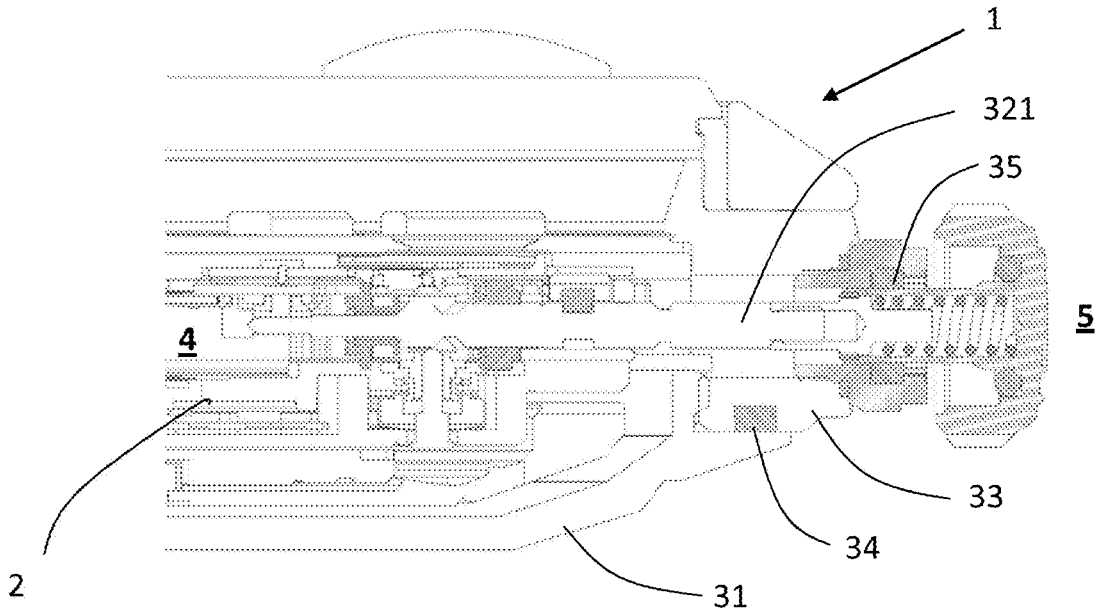
Figure 3:
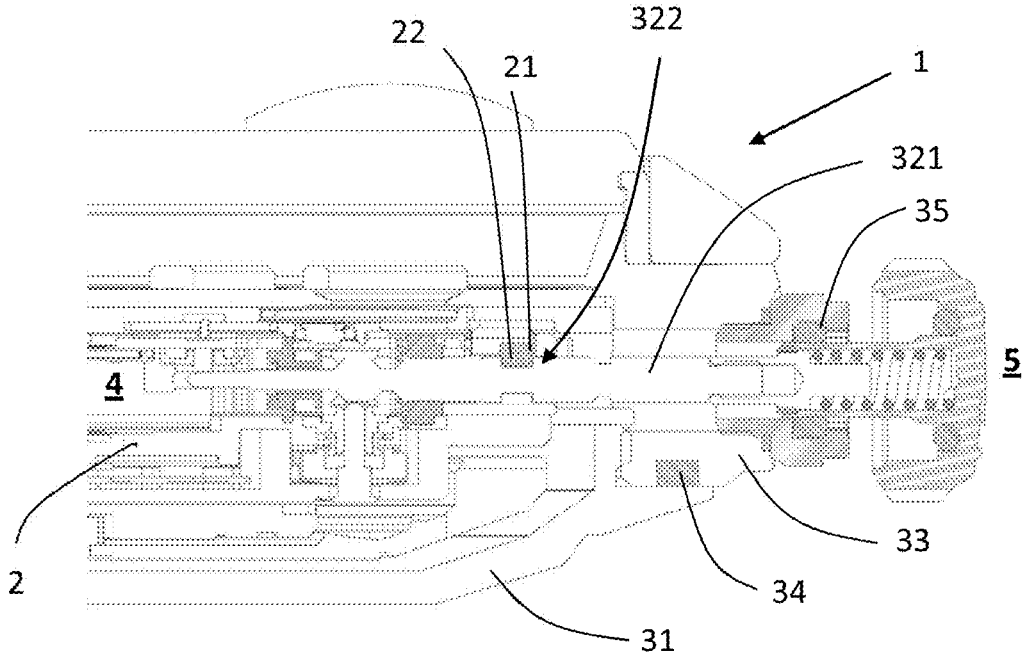
Figure 4:
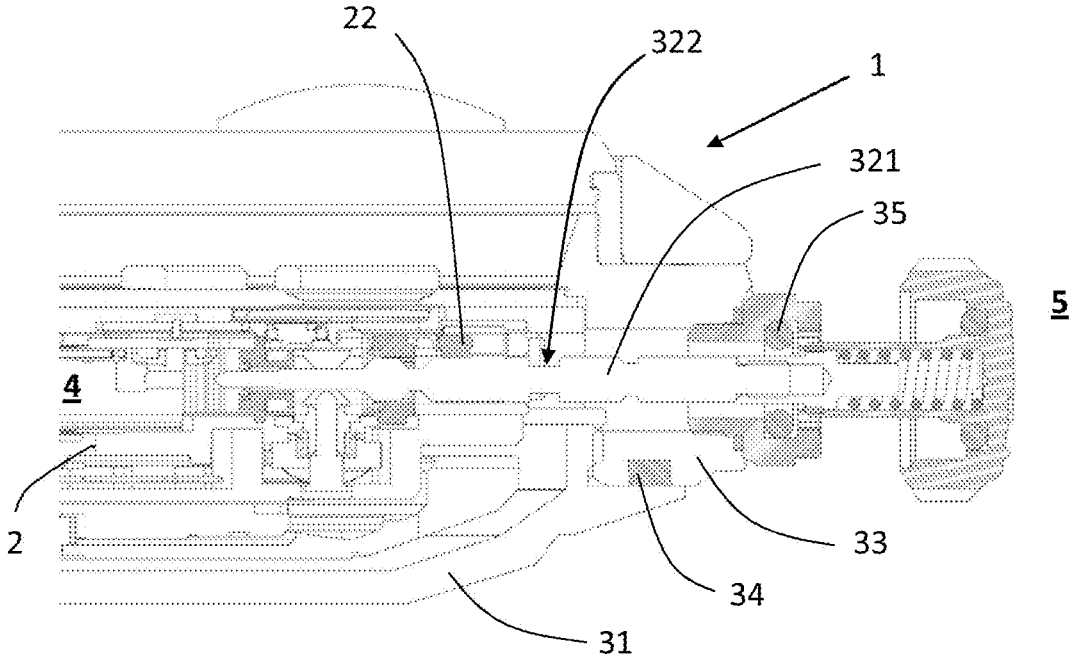

The second element is a displaceable element, more particularly displaceable between a first configuration and a second configuration. These two configurations may be achieved via different positions of the second element. The second element is displaceable longitudinally, for example, that is to say in the longitudinal direction of the second element. FIGS. 1, 2 and 3 illustrate positions of the first configuration. FIG. 4 illustrates a position corresponding to the second configuration.

The second element is arranged in such a way that, in the second configuration, the second element is adapted to ensure the sealing integrity of the case and is arranged in such a way that, in the first configuration, the second element is adapted to permit fluid communication between the interior 4 of the watch case and the environment 5 outside the watch case.

The second element passes through the case middle, for example. The watch case further comprises a second sealing gasket 35. The second sealing gasket cooperates with the second element in order to ensure the sealing integrity of the watch case at the level of the interface between the second element and the case middle.

The state of the second joint may define the sealing integrity and the configuration of the second element. Thus, when the second joint is in contact with only one of the parts, at the interface of which it is intended to ensure the sealing integrity, the interior of the watch case is in fluid communication with the exterior and the second element is accordingly in the first configuration. When the second joint is in contact with the two parts, at the interface of which it is intended to ensure the sealing integrity, and when it is compressed between these two parts, the interior of the watch case is insulated from the exterior, the case is then water-resistant, and the second element is in the second configuration. Finally it is possible, between these two configurations, to define a limit configuration in which the second joint is just in contact with the two parts, at the interface of which it is intended to ensure the sealing integrity, but without it being compressed between these two parts. In this limit configuration, it is possible to speak of a partial sealing integrity of the watch case.

The second sealing gasket is a second O-ring seal, for example. This second sealing gasket is housed, for example, in a groove in the case middle or in a piece that is necessary for securing the second element, attached to the case middle. As an alternative or in addition, a second sealing gasket may be housed in a groove in the second element. As an alternative or again in addition, a second sealing gasket may be housed in a back of a cap of the second element, more particularly in the back of a crown.

The second element, in the second configuration, is in a situation of contact with the second sealing gasket 35 and, in the first configuration, is in a situation of interrupted contact or partially interrupted contact with the second sealing gasket.

Preferably, the second element exhibits a portion 321 of reduced cross section intended to come into register with the second sealing gasket 35 in the first configuration of the second element. The portion of reduced cross section may comprise a first recess or a first groove provided on the second element.

On the assumption that the second element comprises a stem, this stem has a circular shape, for example, and more particularly the stem is preferably of overall cylindrical shape. The second element may comprise a stem and a crown attached to the stem. As a further alternative, the second element may comprise a stem and a cap attached to the stem.

On the assumption that the second element comprises a stem, this stem exhibits a second recess or a second groove 322 intended to cooperate with a pull-out piece 21, more particularly intended to cooperate with a pad 22 of the pull-out piece. In particular, the second groove is intended to receive the pull-out piece pad. The position of the pull-out piece may thus be controlled by the position of the stem, by action of the second groove on the pull-out piece pad.

Figure 5:
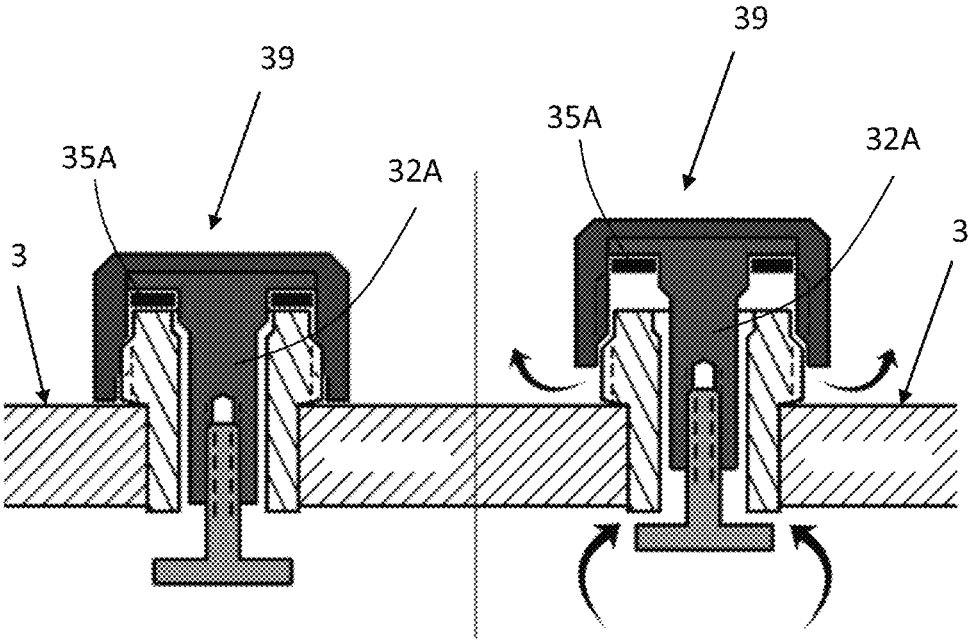
FIG. 5 is a view in cross section of a first variant of the embodiment of the timepiece in different configurations.

In a first variant of the embodiment of the timepiece depicted in FIG. 5, the second element is a stem 32A of a valve 39. In this variant, the stem 32A is screwed onto the case middle 3 and may be displaced in a helical link between a first configuration where a clearance is present between the stem and the case middle (FIG. 5, right-hand view) and a second configuration where the sealing integrity between the stem and the case middle is ensured (FIG. 5, left-hand view), more particularly being ensured by means of a gasket 35A. The stem 32A may be screwed onto the case middle 3 and may be displaced in a helicoidal link by means of a cap that is integral with the second element or is part of the second element.

Figure 6:
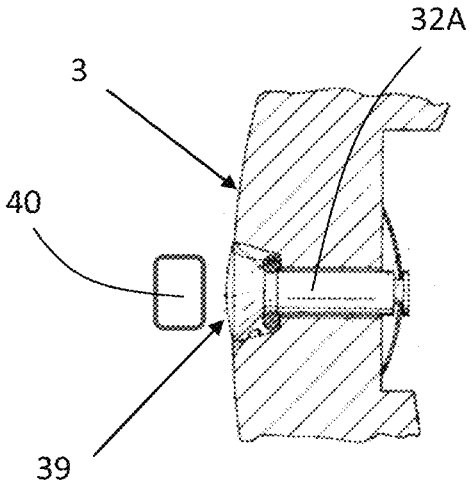
FIG. 6 is a view in cross section of a second variant of the embodiment of the timepiece.

In a second variant of the embodiment of the timepiece depicted in FIG. 6, the second element is also a stem 32A of a valve 39. In this variant, the stem 32A is slidably mounted in the case middle, more particularly mounted as a sliding pivot in the case middle 3. A spring, more particularly a spring disposed in the interior of the watch case, returns the stem to a second configuration where the sealing integrity between the stem and the case middle is assured (FIG. 6), more particularly by the action of a second sealing gasket. The stem has a head on the exterior of the watch case. This head is configured to be operated by a wearer or a watchmaker, via a tool 40. In fact, with the help of the tool 40, it is possible to act on the head of the stem, in particular to pull on the head of the stem, against the spring, so as to bring the stem into a first configuration where a clearance exists between the stem and the case middle.

These two previous variants may be adapted to diver's watches in particular, in which an improved sealing integrity is provided at the interface between the crown stem and the case middle and/or comprising a sealing gasket at the level of the crown.

In a third variant of the embodiment of the timepiece not depicted here, the second element may be a push-button stem.

A mode of implementation of a method of assembling a timepiece is described below.

The movement 2 is cased-up in a first stage, that is to say the movement is integrated into the watch case. This operation is performed, for example, by a watchmaker in the course of production of the timepiece or by a watchmaker in the course of an after-sales service operation. The first stage is intended to insert and secure the movement in a water-resistant watch case in such a way as to permit the adjustment of the movement. It includes more particularly the insertion of a stem making it possible to proceed to the various manipulations of the movement. This stem may be a working stem, which is withdrawn before screwing the back in place and is replaced by a final stem once the back has been screwed in place.

Once the movement has been cased-up, adjustment of the movement is performed in a second stage. Adjustment of the rate of the movement is performed in particular.

The rate M1 of the cased-up movement is measured in a third stage.

In a fourth stage, the second element is positioned in a first configuration, in which fluid communication between the interior 4 of the case and the environment 5 outside the case is permitted. In particular, in the first configuration, the portion 321 of reduced cross section of the stem comes into register with the second sealing gasket 35. The gasket is in contact with only a single part, being either the case or the second element.

The displacement intended to place the second element in the first configuration is permitted by action of the watchmaker on a third element of the watch movement, more particularly by action on the pull-out piece 21, in particular on the pad 22 of the pull-out piece. This stage may thus only be implemented with the back of the case removed. This stage may thus not be implemented by the wearer of the watch. As a variant, it is possible to withdraw the winding stem completely, more particularly when the watchmaker utilizes a working stem and when he replaces the working stem with a final stem after securing the first element.

In order to implement the fourth stage in a secure manner, preferably a modified support is used. This support comprises, for example, an abutment for limiting the withdrawal of the stem from the movement and for ensuring that the stem arrives perfectly in the first configuration. This abutment thus defines a position corresponding to the first configuration, in which position the stem remains engaged in the pinions and wheels of the systems functioning with the help of the stem. Preferably, the first configuration may be achievable after the complete insertion of the stem into the movement, or at the very least after a deeper insertion of the stem into the movement. As a variant, the stem, more particularly the working stem, could be withdrawn completely from the movement in order to achieve the first configuration. This solution is associated with a greater risk, however, since it requires a subsequent insertion of the final stem without being able to satisfy oneself visually that it engages well in the sliding pinion, and accordingly it calls for a certain dexterity.

On the assumption that the second element is a stem 32A of a valve 39, as depicted in FIG. 6, the fourth stage is performed by the watchmaker with the help of a tool 40, more particularly a tool for operating a case valve. This fourth stage is thus implemented after the stages of closing the case.

In a fifth stage, the case is closed by fitting the first case element 31, more particularly the back 31, and locking it in place. Closing the case may comprise screwing the back 31 onto the case middle 33 or mounting the back with the help of screws. Locking the back on the case middle 33 deforms the first sealing gasket 34, in particular by compressing it.

In a sixth stage, the case is closed by actuation of the second element 32. Actuation of the second element allows it to pass from its first configuration to a second configuration, in which the fluid communication between the interior 4 of the case and the environment 5 outside the case is limited. The gasket 35 is brought into contact with the two parts: the case and the second element. Ideally, for example by an action of screwing the crown, the gasket 35 is compressed in order to guarantee greater sealing integrity.

In this second configuration, the fluid communication between the interior 4 of the case and the environment 5 outside the case is limited as much as possible. This fluid communication may be limited sufficiently in order for the watch case to be water-resistant, more particularly water-resistant to 100 m or 300 m or 1220 m according to standards NIHS 92-10 (1986) or NIHS 92-11 (1996). More particularly, this fluid communication may be limited sufficiently for it to be less than or equal to 50 μg/min for air with a difference in pressure of 2 bar between the environment 4 inside the watch case and the environment 5 outside the watch case.

Actuation of the second element 32 may comprise a displacement of the second element from the first configuration to the second configuration, being more particularly a longitudinal displacement of the stem, in particular of the winding stem. This actuation may also take place by means of a helicoidal displacement (screwing of the crown, which compresses a gasket).

The second element 32 is preferably arranged so that the passage from the first configuration to the second configuration of the second element causes an increase in pressure in the case of less than or equal to 5%, in particular in the order of 2%, of the increase that would be caused by:

passage of the first element from a third configuration, in which fluid communication between the interior 4 of the case and an environment 5 outside the case is permitted, to a fourth configuration, in which fluid communication between the interior 4 of the case and the environment 5 outside the case is limited, assuming that this passage from the third configuration to the fourth configuration makes this watch case water-resistant or hermetically sealed, or positioning and securing the first element on the rest of the case.

In other words, the second element 32 is preferably arranged so that passage from the first configuration to the second configuration of the second element causes a displacement of fluid inside the case of less than or equal to 25%, or even less than or equal to 10%, or even less than or equal to 5% of the displacement of fluid caused by:

passage of the first element from the third configuration, in which fluid communication between the interior 4 of the case and the environment 5 outside the case is permitted, to the fourth configuration, in which fluid communication between the interior 4 of the case and the environment 5 outside the case is limited, on the assumption that this passage from the third configuration to the fourth configuration makes this watch case water-resistant or hermetically sealed, or positioning and securing the first element on the case or on the rest of the case.

The second element 32 is arranged, for example, so that passage from the first configuration to the second configuration causes an increase in pressure inside the case of less than or equal to 0.1% or less than or equal to 0.5% and/or causes a reduction in the free volume in the interior of the case of less than or equal to 0.5% or less than or equal to 0.2% and/or causes a variation in rate considered to be zero.

Preferably, the volume of gas displaced by the second element 32 inside the watch case is less than or equal to 40 $mm^3$, or even less than or equal to 30 $mm^3$, or even less than or equal to 10 $mm^3$, or even less than or equal to 1%, or even less than or equal to 0.5%, of the free volume inside the watch case. The volume of gas displaced is defined between:

a limit position of the second element where the sealing integrity of the watch case is just achieved, more particularly the gasket being just in contact with the parts, at the interface of which it must assure the sealing integrity, without compression of the gasket;

a second position of the second element, in which the volume displaced is maximized, or a second position of the second element, in which the second element is present in normal use of the watch (for example, configuration of a screwed crown). In this second position, the gasket is in contact with the parts, at the interface of which it must assure the sealing integrity, and it is compressed in order to ensure a sufficient degree of sealing integrity.

In the second configuration, the second element is preferably in a situation of contact with the second sealing gasket 35 and, in the first configuration, the second element is preferably in a situation of interrupted contact or partially interrupted contact with the sealing gasket.

In a seventh stage, the rate M2 of the movement enclosed inside the watch case is measured. The stage of measurement of the rate may be part of a test of the sealing integrity of the case.

In an optional eighth stage, the rates M1 and M2 measured in the course of the preceding stages are compared.

The method of assembling described here, in the case of a water-tight watch case, allows the adjustment of the movement to be kept as it was performed outside the case, or in-situ in the movement, prior to closing the back. In a general and simple manner, the second element is withdrawn before or after closing the first case element, and the second case element is inserted once more, or a new case element is inserted subsequently, in any event once the first case element has been put in place and secured. In a safer and more elegant manner, it is similarly possible to propose a specific position corresponding to the second configuration, which is only accessible by action of the watchmaker on the pad of the pull-out piece, and which guarantees that the second element of the winding stem type remains inserted to its extremity. In this specific position, the stem may be inserted to its extremity into one or a plurality of pinions of a stem mechanism, more particularly a sliding pinion, while ensuring that a portion of stem of predetermined diameter is disposed at the level of the stem hole formed on the case middle at the moment of closing the back, in such a way as to allow air to pass between the case middle and the stem. This position may be determined precisely by means of an assembly support. This position is preferably a distinct position of the stem positions making it possible to ensure the watch functions of winding and correction, more particularly correction of the time, correction of the time zone, correction of the date.

In fact, in several traditional designs of winding crowns, sealing integrity (limited) is maintained, even in the adjustment mode. A constant cross section of a crown stem cooperates with a gasket in order to compress the latter, in the different positions of the stem dedicated to winding (FIG. 1) and to the various corrections (FIGS. 2 and 3).

The method of assembling and, where appropriate, a support adapted to the method, allow the objectives to be achieved. The stem may be inserted normally by the watchmaker to allow him to proceed to adjustment of the movement. At the moment at which he wishes to close the back, he may withdraw the stem as far as the specific position by action on the pad of the pull-out piece and the use of the appropriate support. In this specific position, the fine part or the part of the stem with reduced cross section is at the level of the gasket 35. The back may then be closed and locked without causing an increase in pressure, and the watchmaker may then insert the stem completely into the movement without risk. The pad of the pull-out piece makes it possible to prevent the wearer subsequently from withdrawing the stem too far and to prevent the loss of the sealing integrity of the case, this sealing integrity preferably being similarly guaranteed in the positions of adjustment or correction.

As an alternative, as seen above, the working stem may be removed by action on the pad of the pull-out piece, before screwing on the back and then putting in place, in a second stage, a final stem of the product. The final stem is put in place with the back closed, being careful to engage it properly in the sliding pinion.

The first configuration of the stem may comprise the position of the stem in which it is withdrawn furthest from the case middle. The first configuration of the stem may comprise a position of the stem in which the crown is screwed out.

Preferably, the first configuration of the stem may comprise a position of the stem in which the crown is screwed out and/or a position of the stem permitting winding of the movement and/or at least one position of the stem permitting correction, more particularly a position of the stem permitting correction of the date and/or a position of the stem permitting correction of the time zone and/or a position of the stem permitting correction of the time.

Preferably, the first configuration may comprise a plurality of positions of the second element, and/or the second configuration may comprise a plurality of positions of the second element.

The second configuration of the stem may comprise a position of the stem in which the crown is screwed in, or the position in which the stem is introduced as far as possible into the case middle.

The second element may be arranged to be movable unidirectionally from the first configuration to the second configuration. In particular, the second element may be arranged to be movable from the second configuration to the first configuration by the action of a watchmaker on the movement, and/or the second element may be arranged to be freely movable from the first configuration to the second configuration.

The problem addressed by the method described above arises for watches of which the necessary accuracy of adjustment is important. In fact, the variation in rate brought about by the variation in pressure is negligible for the majority of watches, a fortiori for watches which do not have a reliable system of sealing integrity at the level of the winding crown.

The invention claimed is:

1. A method of assembling a timepiece comprising a watch movement and a water-resistant case, the method comprising:

a first stage of closing the case by fitting and securing a first element, and then a second stage of closing the case by actuation of a second element, the second element being mobile between a first configuration, in which a fluid communication between the interior of the case and an environment outside the case is permitted, and a second configuration, in which the fluid communication between the interior of the case and the environment outside the case is limited, the second stage of closing being an actuation of a passage of the second element from the first configuration to the second configuration.

2. The method of assembling as claimed in claim 1, wherein the second element is arranged so that the passage from the first configuration to the second configuration of the second element causes a displacement of fluid inside the case of less than or equal to 25% of the displacement of fluid caused by:

passage of the first element from a third configuration, in which a fluid communication between the interior of the case and the environment outside the case is permitted, to a fourth configuration, in which the fluid communication between the interior of the case and the environment outside the case is limited; or positioning and securing the first element on the case.

3. The method of assembling as claimed claim 2, wherein the second element is arranged so that the passage from the first configuration to the second configuration of the second element causes a displacement of fluid inside the case of less than or equal to 10% of the displacement of fluid caused by:

passage of the first element from a third configuration, in which a fluid communication between the interior of the case and the environment outside the case is permitted, to a fourth configuration, in which the fluid communication between the interior of the case and the environment outside the case is limited; or positioning and securing the first element on the case.

4. The method of assembling as claimed in claim 1, wherein the method comprises a third stage of testing the sealing integrity of the case subsequently to the second stage of closing the case.

5. The method of assembling as claimed in claim 1, wherein the method comprises, prior to the first stage of closing the case, adjusting a rate of the movement.

6. The method of assembling as claimed in claim 1, wherein the first stage of closing the case comprises screwing a back onto a case middle.

7. The method of assembling as claimed in claim 6, wherein screwing the back onto the case middle deforms a first sealing gasket.

8. The method of assembling as claimed in claim 1, wherein the second stage of closing the case comprises a displacement of the second element from the first configuration to the second configuration.

9. The method of assembling as claimed in claim 1, wherein the second element, in the second configuration, is in a situation of contact with a second sealing gasket and, in the first configuration, in a situation of interrupted contact or partially interrupted contact with the second sealing gasket.

10. The method of assembling as claimed in claim 1, wherein the second element is a stem and wherein, in the first configuration, the stem exhibits a portion of reduced cross section facing the second sealing gasket.

11. The method of assembling as claimed in claim 1, wherein the method comprises actuating the second case element so as to position the second case element in the first configuration, the actuating being prior to the first stage of closing the case.

12. The method of assembling as claimed in claim 1, wherein the second element is a stem and wherein a displacement in order to place the second element in the first configuration requires an action on a third element of the watch movement.

13. The method of assembling as claimed in claim 1, wherein the second element is a stem and wherein a displacement in order to place the second element in the second configuration is performed independently of an action on a third element of the watch movement.

14. The method as claimed in claim 1, wherein the second case element is a stem.

15. The method as claimed in claim 14, wherein the stem is at least one selected from the group consisting of:

a winding stem, a stem of a valve, and a stem of a push-button.

16. The method as claimed in claim 1, wherein said first stage and said second stage are implemented during assembling of the timepiece rather than after assembling of the timepiece during use of the timepiece by a wearer.

17. The method as claimed in claim 1, wherein said second stage of closing the case inhibits increasing of pressure within the case during closing of the case during assembly.

18. The method as claimed in claim 1, further including providing a timepiece obtained by implementation of the method.

19. The method as claimed in claim 18, wherein the timepiece provided further comprises a movement and a watch case comprising a first element, a second element and a third element, the first element and the third element forming the watch case with the second case element, the second element being arranged so as to be mobile between a second configuration adapted to ensure the sealing integrity of the watch case and a first configuration adapted to permit fluid communication between the interior of the watch case and an environment outside the watch case.

20. The method as claimed in claim 19, wherein at least one selected from the group consisting of:

a stem has a portion having a reduced cross section adapted to come into a position facing a second sealing gasket in the first configuration of the stem, the second element is arranged to be movable unidirectionally from the first configuration to the second configuration, the second element is arranged to be movable from the second configuration to the first configuration by the action of a watchmaker on the movement, and the second element is arranged to be freely movable from the first configuration to the second configuration.

21. The method as claimed in claim 19, wherein the second case element is a stem.

22. The method as claimed in claim 21, wherein the stem is at least one selected from the group consisting of:

a winding stem, a stem of a valve, and a stem of a push-button.

* * * * *